United States Patent [19]

Lewellen, Jr. et al.

[11] 4,105,526

[45] Aug. 8, 1978

[54] PROCESSING BARREL WITH STATIONARY U-SHAPED HANGER ARM AND COLLAR BEARING ASSEMBLIES

[75] Inventors: Wendell G. Lewellen, Jr., Ann Arbor; Loran A. Lankford, Redford, both of Mich.

[73] Assignee: Imperial Industries, Inc., Belleville, Mich.

[21] Appl. No.: 791,669

[22] Filed: Apr. 28, 1977

[51] Int. Cl.[2] ..... C25D 17/04; C25D 17/20

[52] U.S. Cl. ..... 204/213; 204/212

[58] Field of Search ..... 204/213, 212; 259/81 R; 134/160; 74/406, 248; 248/202, 324

[56] References Cited

U.S. PATENT DOCUMENTS 3,803,007 4/1974 Jessup ..... 204/213 X

*Primary Examiner*—Arthur C. Prescott

*Attorney, Agent, or Firm*—Cullen, Settle, Sloman & Cantor

[57] ABSTRACT

The processing apparatus comprises a rotatable barrel supported from a stationary cross bar by a pair of stationary U-shaped hanger arm and collar bearing assemblies of rigid construction, with one assembly opposite each end of the barrel. Inner portions of the collar bearings are received in openings provided in the ends of the barrel and upon which the barrel is adapted to rotate about the axis of the barrel. The outer portions of the collar bearings are located outside of the barrel and are provided with circumferentially extending annular grooves which surround the axis of the barrel. The ends of the U-shaped hanger arms are secured to mounting lugs provided on the cross bar, with the bottoms of the U-shaped hanger arms being located in the grooves and wrapped around the collar bearings. The hanger arms are each secured in two places, one to the corresponding mounting lug and the other to the corresponding stationary collar bearing.

5 Claims, 6 Drawing Figures

PROCESSING BARREL WITH STATIONARY U-SHAPED HANGER ARM AND COLLAR BEARING ASSEMBLIES

BACKGROUND OF THE INVENTION

1. Field of the Invention

This invention relates generally to a processing barrel or apparatus of the type which is immersed and rotated in a liquid bath during the processing of articles contained within the barrel. The processing apparatus may be used with plating, phosphating, cleaning, chromating and other processing baths now available.

2. Description of the Prior Art

This invention constitutes an improvement over the processing apparatus disclosed in U.S. Pat. No. 3,202,006 of W. G. Lewellen, Jr., issued Aug. 24, 1965 and entitled "Rotating Mechanism For Plating Barrel Or The Like". The two hangers 14 and 16 disclosed therein are metal castings and are provided with bearing connections to the ends of the barrel as indicated by the numerals 18 and 20. The opposite ends of the hangers 14 and 16 are secured to the cross bar 32 by means of a plurality of bolts as shown in FIG. 1. The hanger arm castings are expensive to manufacture and must be coated with plastisol prior to use in a plating operation to prevent corrosion. In addition in use formed polypropylene covers are provided on the hanger arms to guard against impact damage and corrosion.

A preliminary novelty investigation was conducted in the U.S. Patent and Trademark Office and disclosed several additional prior art patents. The Simpson U.S. Pat. No. 1,848,391 of Mar. 8, 1932 discloses grooved pulleys 39 provided on each end of the plating barrel. Belts 40 extend between pulleys 39 and associated pulleys 41 carried by shaft 26. The Howard U.S. Pat. No. 484,535 of Oct. 18, 1892 discloses a plating barrel suspended by wires *d'* as best seen in FIGS. 2 and 3. The wires *d'* are looped around a center pin on each end of the barrel. The House U.S. Pat. No. 2,451,676 dated Oct. 19, 1948 discloses a plating barrel 12 which is supported by bands or supports 19 and 21 which extend around journals 28 and 33 respectively as shown in FIG. 1.

SUMMARY OF THE INVENTION

It is a feature of the present invention to provide a processing apparatus comprising an elongated barrel having a rotatable axis and including openings in the ends thereof through which the axis extends and a pair of generally cylindrical stationary collar bearings having inner and outer portions, with the inner portions of the collar bearings being received in the barrel openings and upon which the barrel is adapted to rotate. In such a construction, the outer portions of the collar bearings have circumferentially extending annular grooves surrounding the axis. A stationary cross bar is located above and spaced from the barrel. The end portions of the cross bar extend beyond the ends of the barrel and have mounting lugs depending therefrom. A pair of U-shaped stationary hanger arms are located beyond the ends of the barrel for suspending the barrel from the cross bar. The ends of the hanger arms engage and are secured to the mounting lugs, with the bottoms of the U-shaped hanger arms being located in the grooves and wrapped around and secured to the collar bearings.

It is a further feature of the present invention to provide a processing apparatus wherein the rotatable barrel is suspended at opposite end thereof from a cross bar by a pair of stationary hanger arm and bearing assemblies which are rigid and are made from materials which are not required to be treated after manufacture.

A still further feature of the present invention is to provide a processing apparatus of the aforementioned type which is simple in construction; is easy to manufacture; is efficient in operation; and is economical to maintain.

DETAILED DESCRIPTION OF A PREFERRED EMBODIMENT

Figure 1:
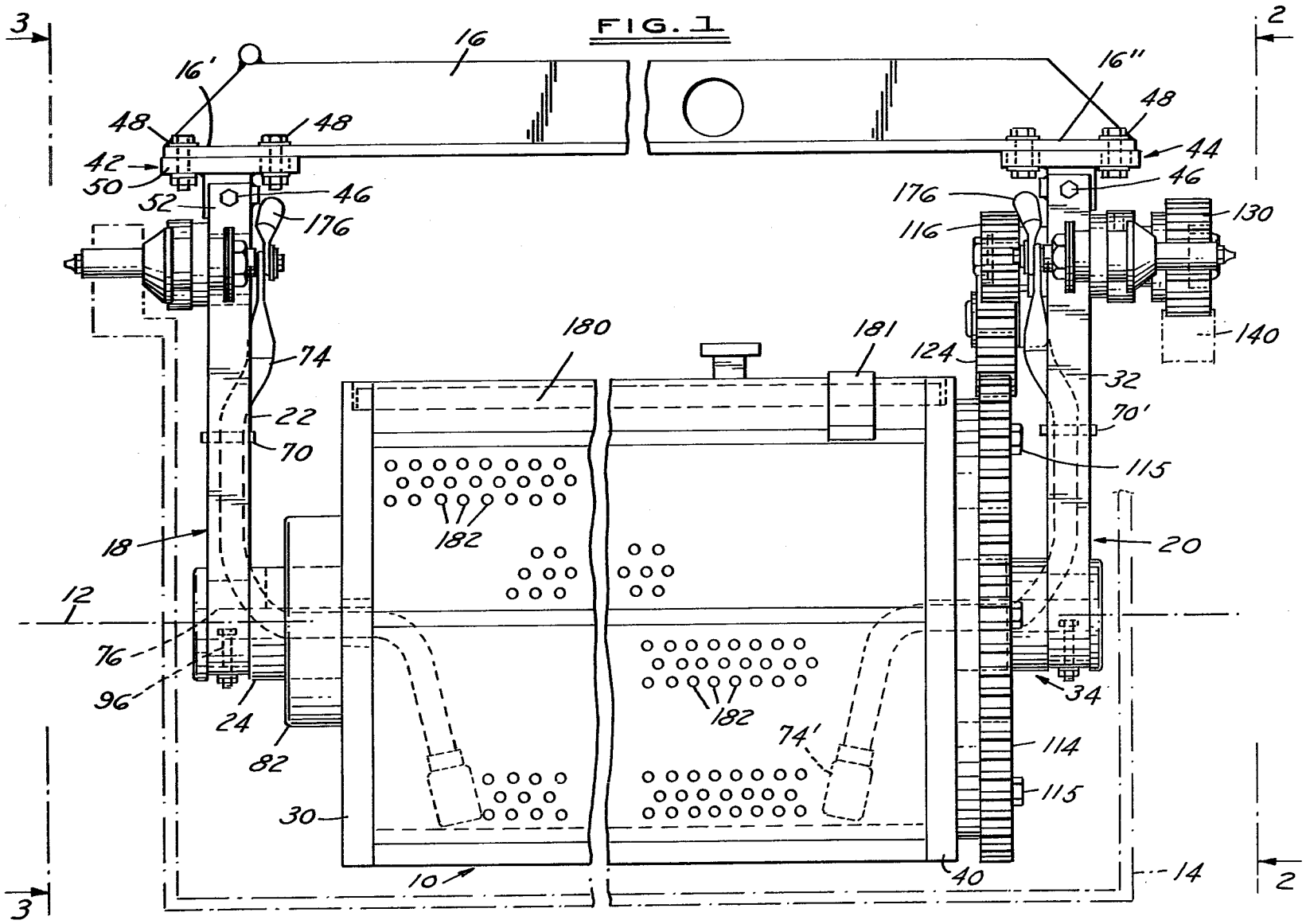
FIG. 1 is an elevational view of the plating apparatus.

Referring now to the drawings, an elongated plating barrel 10 having an axis 12 is rotatably supported within a plating tank 14 as is conventional in the art. The barrel 10 is suspended by or supported from the overhead cross bar, crosshead or tee iron 16 by a pair of stationary hanger arm and collar bearing assemblies 18 and 20 provided on the idle end and gear end of the barrel 10 respectively.

Figure 5:
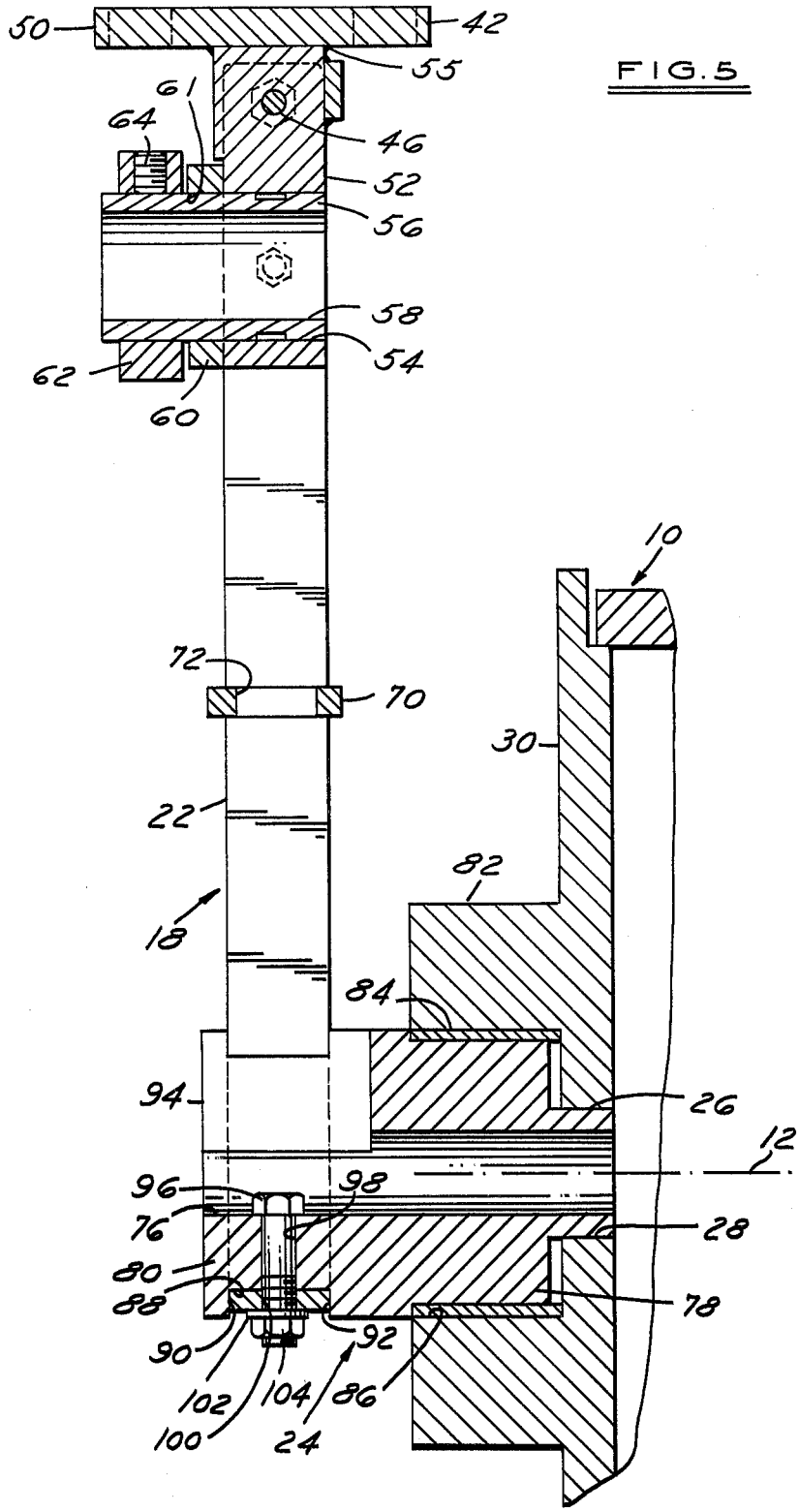
FIG. 5 is a sectional view taken on the line 5—5 of FIG. 3 and illustrating structural features of the stationary hanger arm and collar bearing assembly at the idle end of the plating apparatus.

Hanger arm and collar bearing assembly 18 includes a rigid U-shaped hanger arm 22 and a generally cylindrical collar bearing 24 terminating in a cylindrical element 26 which is received in a circular opening 28 provided in the opposing end wall 30 of barrel 10 as shown in FIG. 5. The center of opening 28 lies on the axis 12 of the barrel.

Figure 4:
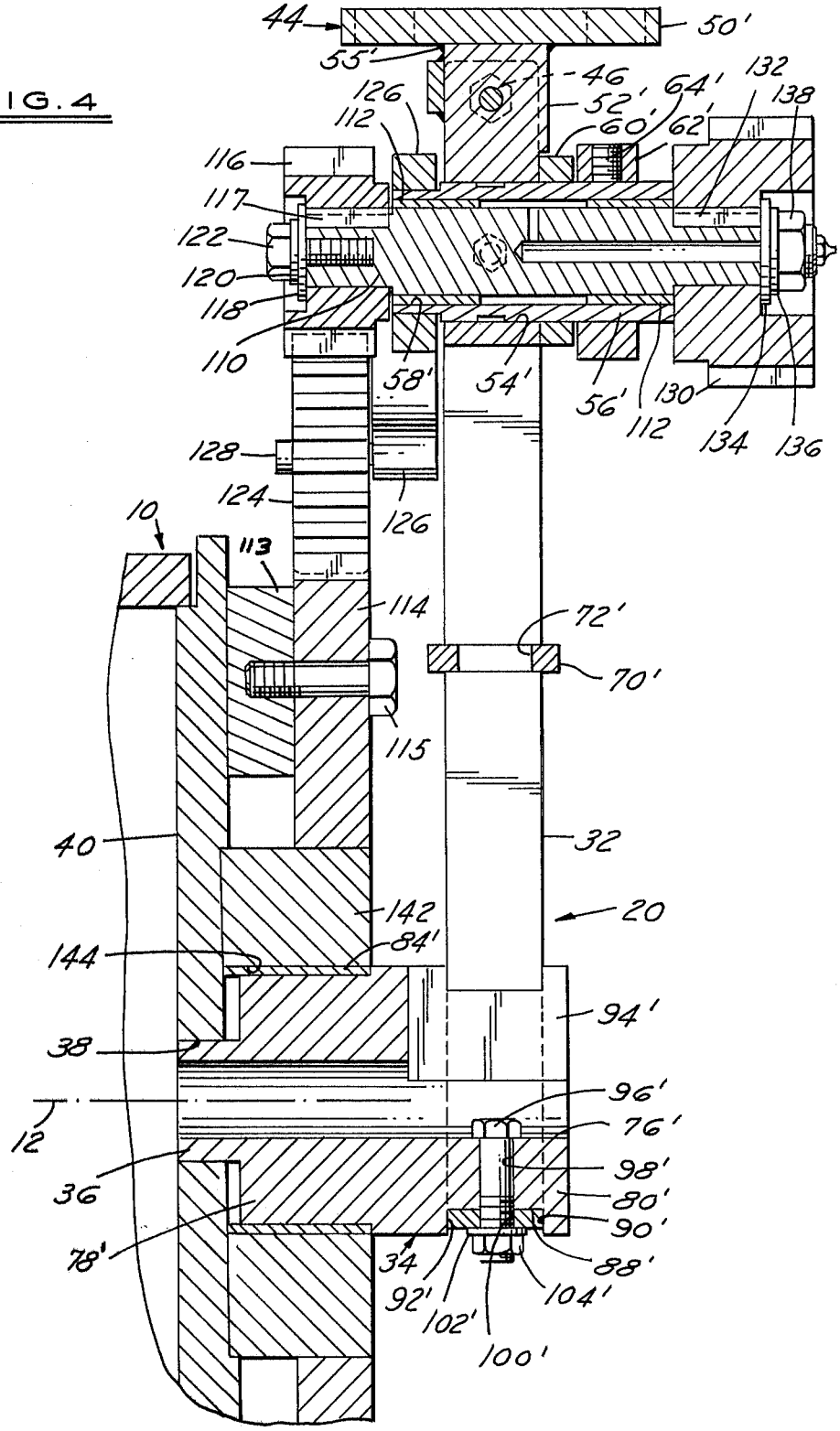
FIG. 4 is a sectional view taken on the line 4—4 of FIG. 2 and illustrating structural features of the stationary hanger arm and collar bearing assembly at the drive end of the plating apparatus.

The other hanger arm and collar bearing assembly 20 is generally identical in construction to assembly 18 and includes a rigid U-shaped hanger arm 32 and a generally cylindrical collar bearing 34 terminating in a cylindrical element 36 which is received in circular opening 38 provided in the opposing end wall 40 of barrel 10 as shown in FIG. 4. The center of opening 38 lies on the barrel axis 12.

Each hanger arm 22, 32 is a rigid strap or band bent into a U configuration and supported from a mounting lug to carry a tensile load as will subsequently be described. The hanger arm 22, 32 is generally made from titanium metal or other corrosion resistance material such as Monel, Carpenter 20 or Type 316 stainless steel.

Each collar bearing 24, 34 is made from a tough, abrasion resistant plastic such as polypropylene and is bolted or non-rotatably secured to hanger arm 22, 32 respectively. The barrel 10 is adapted to be rotated on the hanger arm supported collar bearings 22 and 34.

The cross bar 16 is secured to the upper ends of the U-shaped hanger arms 22 and 32, to facilitate the raising and lowering of the barrel 10 relative to the plating tank 14.

The cross bar 16, as shown in FIG. 1, has a length greater than the length of barrel 10, with the end portions 16' and 16'' of cross bar 16 extending beyond the ends of the barrel 10. The end portions 16' and 16'' are provided with depending mounting lugs or blocks 42 and 44 respectively. The ends of the U-shaped hanger arms 22 and 32 are connected to lugs 42 and 44 respectively each by a threaded bolt and nut 46. Each mounting lug 42, 44 is connected to the cross bar 16 by a plurality of threaded bolts and nuts 48.

Mounting lug 42 includes a generally flat base plate 50 having on the bottom side thereof and located between the ends thereof a hanger arm mounting block 52 which is provided with a transversely extending bore 54 as shown in FIG. 5. The block 52 is welded to base plate 50 at 55. The flat ends of hanger arm 22 engage and are held against the parallel sides of the block 52 by the threaded nut and bolt 46 as shown in FIG. 3.

A generally cylindrical tubular bearing housing 56 having a bore 58 is received in bore 54 of block 52 and provides the pivot support or mount for the elongated electrode horn bracket 60. The bracket 60 has a centrally located opening 61 through which the bearing housing 56 extends. A set collar 62 is located on the bearing housing 56 and is secured thereto by a set screw 64 which retains the bracket 60 on bearing housing 56 but provides for pivoting movement of bracket 60.

Figure 3:
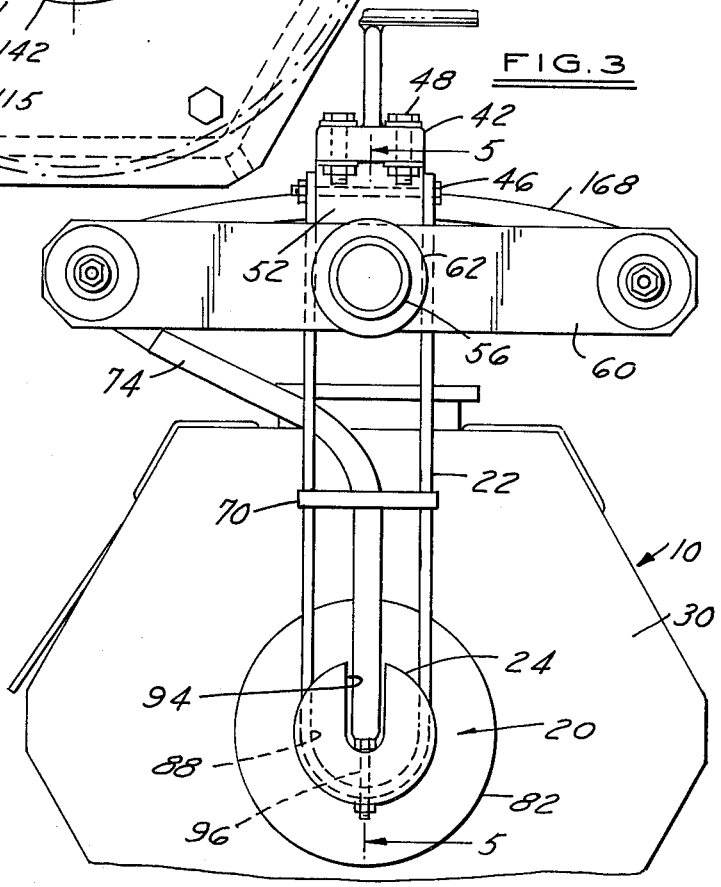
FIG. 3 is another end view of the idle end of the plating apparatus looking in the direction of arrows 3—3 of FIG. 1.

Continuing with the description of the hanger arm and collar bearing assembly 18 located at the idle end of the barrel 10, a dangler locking insert 70 having an opening 72 is mounted between the parallel arm portions of hanger arm 22 for positioning the electrical dangler or cable 74 as shown in FIG. 3. The cable 74 is secured on one end to the electrode horn 156 (FIG. 6) and extends downwardly therefrom through insert 70 through collar bearing 24 into the barrel 10 as shown in FIG. 1.

The collar bearing 24 has a longitudinal bore 76 concentric to axis 12 and includes inner and outer portions 78 and 80 respectively. Inner portion 78 fits into the end wall 30 including the extension or hub 82 of the wall 30 as shown in FIG. 5. Part of the inner portion 78 is reduced in diameter and is provided with an annular bearing sleeve 84 for engagement with the bore 86 provided in extension 82.

The outer portion 80 of collar bearing 24 extends away from barrel 10 and is provided on the outer periphery thereof with a generally circumferentially extending annular groove 88 having a width corresponding to the width of hanger arm 22. The sides of the groove 88 are defined by surfaces 90 and 92 of the collar bearing 24 as shown in FIG. 5. The top portion of collar bearing 24 is provided with a slot or opening which intersects bore 76 and through which the cable 74 extends prior to entering the interior of barrel 10 via bore 76 of collar bearing 24 as shown in FIG. 1. The bottom of the U-shaped hanger arm 22 is located in groove 88 and is wrapped around the collar bearing 24 as shown in FIGS. 3 and 5. The hanger arm 22 is secured to collar bearing 24 by a bolt 96 which extends through a vertical bore 98 provided in collar bearing 24 and an opening 100 provided in the bottom of the hanger arm 22. A lock washer 102 and nut 104 are provided on the end of bolt 96 to secure the hanger arm 22 and collar bearing 24 together.

Figure 2:
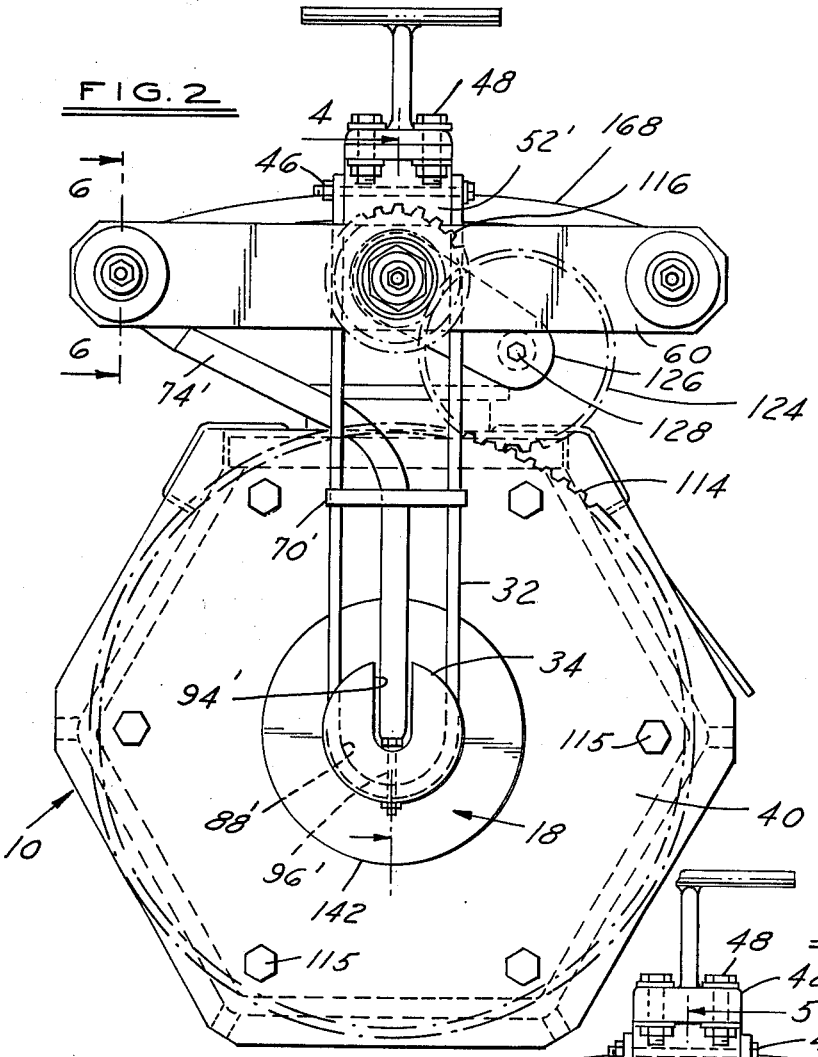
FIG. 2 is an end view of the drive end of the plating apparatus looking in the direction of arrows 2—2 of FIG. 1.

Referring now to FIGS. 2 and 4, the mounting lug 44 includes a generally flat base plate 50' having on the bottom side thereof and located between the ends thereof a hanger arm mounting block 52' which is provided with a transversely extending bore 54'. The block 52' is welded to base plate 50' at 55'. The flat ends of hanger arm 32 engage and are held against the parallel sides of block 52' and are secured thereto by the threaded nut and bolt 46 as shown in FIG. 2.

A generally cylindrical tubular bearing housing 56' having a bore 58' is received in bore 54' of block 52' and provides the pivot support or mount for the elongated electrode horn bracket 60'. The bracket 60' has an opening 61' through which the bearing housing 56 extends. A set collar 62' is located on housing 56' and is secured thereto by a set screw 64' which retain bracket 60' on bearing housing 56' but provides for pivoting movement of bracket 60'.

Each horn bracket 60, 60' is rotatable through a small angular range about its pivot or mount on the mounting block 52, 52' respectively. Rocking of the brackets 60, 60' relative to the hanger arm assemblies facilitates leveling of the plating barrel 10.

The drive for the plating barrel 10 includes a large gear 114. An annular pad, member or spacer 113 is welded to the end wall 40 of barrel 10. The member 13 may consist of a series of ring-like elements welded or otherwise secured together as is known in the art. The gear 114 is non-rotatably fastened to the member 113 by a plurality of bolts 115 and is concentric with axis 12. The gear 114 may, as an example, consist of three separate gear sections or rings made from polypropylene which are laminated together or may be made from a single piece of polypropylene or other material as shown in FIG. 4.

An elongated drive pinion shaft 110 extends through a pair of spaced apart tubular oilite bearings 112 which are located in the bore 58' of bearing housing 56' as shown in FIG. 4. A small pinion gear 116 is keyed at 117 to one end of shaft 110 and is held thereon by means of flat washer 118, lock washer 120 and bolt 122 which is threaded into the end of shaft 110. Gear 116 drives the barrel gear 114 through an idler gear 124.

An idler gear bracket 126 is provided on one end with a collar which rockably surrounds the bushing 56' through which shaft 110 extends for driving pinion gear 116. Idler gear bracket 126 swings freely about the axis of the gear 116 and shaft 110. The other end of the bracket 126 carries a mounting element 128 which mounts the idler gear 124 thereon.

The other end of drive pinion shaft 110 is provided with a drive pinion gear 130 which is keyed thereto at 132 and is held on shaft 110 by means of flat washer 134, lock washer 136 and nut 138 which is threaded on the shaft 110. When the plating barrel 10 is in operative position on processing tank 14, as shown and described in U.S. Pat. No. 3,202,006, the drive pinion gear 130 is driven by another gear 140 (FIG. 1). The gear 140 is rotated by suitable drive mechanism, not shown, which normally is permanently positioned adjacent and fastened to the tank 14.

A dangler locking insert 70' having an opening 72' is mounted between the parallel arm portions of hanger arm 32 for positioning the electrical dangler or cable 74'. The cable 74' is secured on one end to the electrode horn 156 and extends downwardly therefrom through insert 70' and collar bearing 34 into the barrel 10 as shown in FIG. 1.

The collar bearing 34 like bearing 24 has a longitudinal bore 76' concentric to axis 12 and includes inner and outer portions 78' and 80' respectively. Inner portion 78' fits into the end wall 40 including the hub or extension 142 of the wall 40 as shown in FIG. 4. Extension 142 fits into the centrally located opening in gear 114. Part of the inner portion 78' is reduced in diameter and is provided with an annular bearing sleeve 84' for engagement with the bore 144 provided in extension 142.

The outer portion 80' of collar bearing 34 extends away from barrel 10 and is provided on the outer periphery thereof with a generally circumferentially extending annular groove 88' having a width corresponding to the width of hanger arm 32. The sides of the groove 88' are defined by surfaces 90' and 92' of the collar bearing 34 as shown in FIG. 4. The top portion of collar bearing 34 is provided with a slot or opening 94' which intersects bore 76' and through which the cable 74' extends prior to entering the interior of barrel 10 via bore 76' of collar bearing 34 as shown in FIG. 1. The bottom of the U-shaped hanger arm 32 is located in groove 88' and is wrapped around the collar bearing 34 as shown in FIGS. 2 and 4. The hanger arm 32 is secured to collar bearing 34 as shown in FIGS. 2 and 4. The hanger arm 32 is secured to collar bearing 34 by a bolt 96' which extends through a vertical bore 98' provided in collar bearing 24 and an opening 100' provided in the bottom of the hanger arm 32. A lock washer 102' and nut 104' are provided on the end of bolt 96' to secure the hanger arm 32 and collar bearing 34 together.

Figure 6:
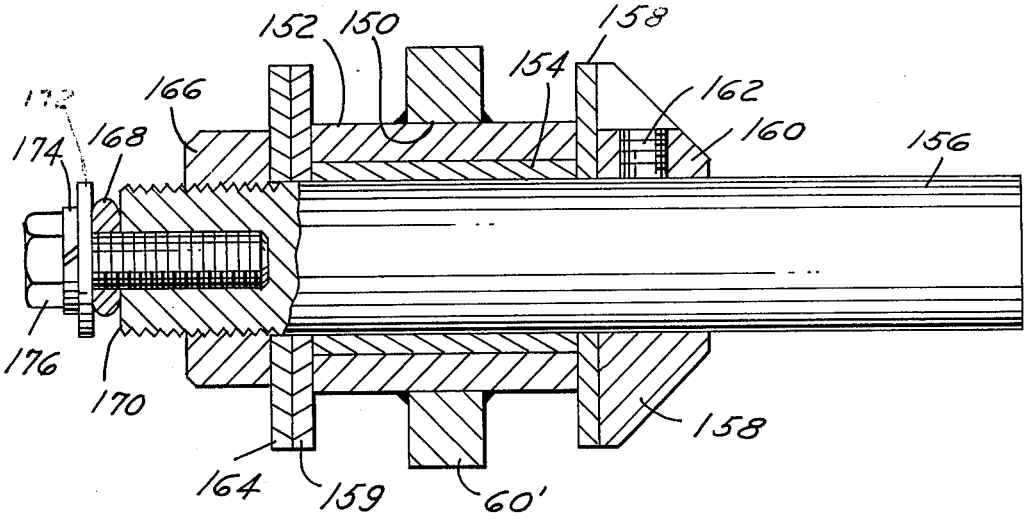
FIG. 6 is a typical sectional view taken on the line 6—6 of FIG. 2.

Each horn bracket 60 and 60' are of generally similar construction. FIG. 6 represents a typical sectional view taken at either end of horn bracket 60, 60'.

FIG. 6 illustrates horn bracket 60' with a bore 150 which has a tubular collar 152 welded thereto. A horn insulating bushing 154 of tubular construction having a length equal to collar 152 is received in collar 152. An elongated horn 156 extends through bushing 154. Located opposite one end of the collar 152 and bushing 154 is a horn insulating washer 158 which is held against the opposing surfaces of the collar 152 and bushing 154 by means of the horn collar 160. Collar 160 is secured to horn 156 by means of a set screw 162. The other end surfaces of collar 152 and bushing 154 abut another horn insulating washer 159 which is backed by a flat washer 164. The washers 159 and 164 are held on horn 156 by a jam nut 166 which is threaded thereon. A horn connecting shunt 168 is electrically connected to the end surface 170 of horn 156 by a flat washer 172, lock washer 174 and bolt 176 which is threaded into the horn 156 as shown in FIG. 6 to maintain the proper electrical connection.

The four electrode horns 156, two on each bracket 60, 60' are supportedly engaged within recess blocks, not shown, which are anchored or secured to the plating tank as disclosed in U.S. Pat. No. 3,202,006. The plating barrel 10 is both supported and furnished the electrical energy through the electrode horns 156. Electrical energy is conducted into the barrel 10 from horns 156 by the aforesaid danglers or cables 74, 74' and by the horn connecting shunts 168, one for each horn bracket 60, 60' having the ends thereof mounted on horns 156 as shown in FIG. 6.

The plating barrel 10 has a removable top or cover 180 through which workpieces are placed into and removed from barrel 10. The cover 180 is retained on the barrel 10 by a plurality of door clamps 181. The barrel has small holes 182 in the sides thereof through which the liquid of the plating bath in tank 14 enters into the barrel 10 to contact the workpieces therein. The barrel shell is formed in one piece from polypropylene.

The operation and function of the barrel and tank assembly including the gear train previously described is disclosed and described in the Lewellen U.S. Pat. No. 3,202,006.

The novel U-shaped hanger arm and collar bearing assemblies eliminate many problems encountered with the hanger constructions utilized in U.S. Pat. No. 3,202,006, such as corrosion and abrasion.

In addition, the novel hanger arm and collar bearing assemblies of the present invention carry the tensile loads more effectively than prior art devices and forms a positive harness for the danglers 74, 74'. Such harness includes the inserts 70, 70' which positions and directs the danglers toward the collar bearings 24, 34 where they extend into the interior of barrel 10.

What is claimed is:

1. A processing apparatus comprising an elongated barrel having a rotatable axis and including openings in the ends thereof through which the axis extends, a pair of generally stationary collar bearings having inner and outer portions, with the inner portions of said collar bearings being received in said barrel openings and upon which said barrel is adapted to rotate, the outer portions of said collar bearings having circumferentially extending annular grooves surrounding the axis, a stationary cross bar located above and being spaced from said barrel, said cross bar having a length greater than the length of said barrel, with the end portions of said cross bar extending beyond the ends of said barrel, mounting lugs depending from and being secured to the end portions of said cross bar, said mounting lugs being mounted above and being spaced from the grooves of said collar bearings, a pair of stationary rigid hanger arms located beyond the ends of said barrel for suspending said barrel from said cross bar, each hanger arm being in the form of an elongated rigid strap of U-shape configuration and of generally rectangular cross-section throughout its longitudinal extent, the ends of each rigid strap engaging opposing surfaces of one of the mounting lugs, with the bottoms of the U-shape rigid straps being received in said grooves and wrapped around said collar bearings, first fastening means securing the ends of each rigid strap to the corresponding mounting lug, and second fastening means securing the bottom of each of said U-shape rigid strap to the corresponding stationary collar bearing.

2. The processing apparatus of claim 1 wherein each of said collar bearings has an axially extending opening therethroughleading into the interior of said barrel and through which an electrode is adapted to extend.

3. The processing apparatus of claim 2 wherein the opening and groove in each of said collar bearings intersect.

4. The processing apparatus of claim 1 wherein said first fastening means comprises a threaded bolt and nut, with the ends of each rigid strap being located on opposite sides of the corresponding mounting lug.

5. The processing apparatus of claim 2 wherein said second fastening means comprises a threaded bolt and nut, with said bolt extending through a bore provided in the corresponding collar bearing which intersects the opening therein.

* * * * *